US011491411B2

(12) United States Patent
Larkin

(10) Patent No.: US 11,491,411 B2
(45) Date of Patent: Nov. 8, 2022

(54) CONSOLIDATED PIT STAND AND CADDY FOR REMOTE-CONTROLLED HOBBY VEHICLES

(71) Applicant: Edward J. Larkin, Easton, PA (US)

(72) Inventor: Edward J. Larkin, Easton, PA (US)

( * ) Notice: Subject to any disclaimer, the term of this patent is extended or adjusted under 35 U.S.C. 154(b) by 379 days.

(21) Appl. No.: 16/837,873

(22) Filed: Apr. 1, 2020

(65) Prior Publication Data

US 2020/0316486 A1 Oct. 8, 2020

Related U.S. Application Data

(60) Provisional application No. 62/830,009, filed on Apr. 5, 2019.

(51) Int. Cl.

| | |
|---|---|
| ***A63H 17/44*** | (2006.01) |
| ***A45C 13/02*** | (2006.01) |
| ***A45C 11/00*** | (2006.01) |

(52) U.S. Cl.

CPC ..... *A63H 17/44* (2013.01); *A45C 11/00* (2013.01); *A45C 13/02* (2013.01)

(58) Field of Classification Search

CPC ..... A63H 17/44; A45C 11/00; A45C 13/00; A45C 7/0054

See application file for complete search history.

(56) References Cited

U.S. PATENT DOCUMENTS

| | | | | | |
|---|---|---|---|---|---|
| 1,481,503 | A * | 1/1924 | Carswell | B25H 1/0007 | 248/172 |
| 2,955,632 | A * | 10/1960 | Stone | E04F 21/0023 | 269/296 |
| 3,127,114 | A * | 3/1964 | Shaw | F21V 21/14 | 362/396 |
| 3,405,781 | A * | 10/1968 | Brown | B66F 7/025 | 187/210 |

(Continued)

FOREIGN PATENT DOCUMENTS

| | | |
|---|---|---|
| EP | 0760411 A1 | 3/1997 |
| KR | 100495277 | 6/2005 |

OTHER PUBLICATIONS

"ICC 3/4" Ceiling Mount J-Hook in 25 Pack", https://www.amazon.com/ICC-ICCMSJH922-J-Hook-25-Pk/dp/B00C7UV0MI/.

(Continued)

*Primary Examiner* — Ernesto A Grano

(57) ABSTRACT

A consolidated pit stand and caddy for storing and transporting remote-controlled hobby vehicles includes a pit stand and a caddy. The pit stand includes a base, a first pillar, a second pillar, an upper adjustable shelf, at least one lower adjustable shelf, an illuminating arm assembly, and a storage section. The first pillar and the second pillar are oppositely positioned of each other about the base. The first pillar and the second pillar are terminally connected onto the base. The upper adjustable shelf is removably mounted to the first pillar and the second pillar. The at least one lower adjustable shelf is removably mounted to the first pillar and the second (Continued)

pillar, below the upper adjustable shelf. The illuminating arm assembly is foldably connected to the upper adjustable shelf. The storage section is oppositely positioned of the first pillar and the second pillar and removably mounted to the base.

5 Claims, 9 Drawing Sheets

(56) References Cited

U.S. PATENT DOCUMENTS 4,127,253 A * 11/1978 Ben-Lea ..... A47B 19/10 248/453
4,183,511 A * 1/1980 Marek ..... B66C 23/48 269/71
4,582,500 A * 4/1986 Hanson ..... A63H 17/44 446/423
4,753,408 A * 6/1988 Wailes ..... H04R 1/026 248/161
D340,840 S * 11/1993 Melk ..... D7/607
5,707,450 A * 1/1998 Thompson ..... B05B 13/0285 118/500
5,833,178 A * 11/1998 Plasse ..... A47B 97/08 248/447
7,213,794 B1 * 5/2007 Jefferies ..... A47B 23/044 248/458
7,237,758 B2 * 7/2007 Nikolic ..... B25H 1/0007 248/676
8,245,856 B1 * 8/2012 Pappin ..... A63H 17/00 211/13.1
8,534,619 B2 * 9/2013 Huang ..... F16M 13/00 248/463
8,596,627 B2 * 12/2013 Lands ..... B25H 1/0007 269/57
8,919,837 B1 * 12/2014 Cauchi ..... A45F 5/00 294/16
9,016,664 B1 * 4/2015 Powers ..... B25H 1/0007 254/8 R
9,527,709 B2 * 12/2016 Zamorano Jones ..... B66F 9/02
9,999,296 B1 * 6/2018 Fan ..... F16M 11/041
10,252,410 B2 * 4/2019 Luis y Prado ..... B25H 1/04
10,293,475 B2 * 5/2019 Luis y Prado ..... B25H 1/14
10,532,783 B2 * 1/2020 Taylor ..... B62D 65/022
2003/0042160 A1 * 3/2003 Godshaw ..... B25H 3/023 206/349
2003/0062663 A1 * 4/2003 Fox ..... B25H 1/0007 269/17
2004/0060878 A1 * 4/2004 Ho ..... B62H 3/12 211/20
2004/0163289 A1 * 8/2004 Pearson ..... G09F 21/02 40/584
2004/0256529 A1 * 12/2004 Richter ..... F16M 11/041 248/309.1
2007/0145210 A1 * 6/2007 Fawcett ..... F16M 13/00 248/176.1
2008/0042020 A1 * 2/2008 Laitila ..... F16M 11/041 248/131
2010/0144234 A1 * 6/2010 Wai ..... A63H 27/14 446/76
2012/0052767 A1 * 3/2012 Martino ..... A63H 17/00 446/465
2012/0063152 A1 * 3/2012 Chang ..... F21S 6/006 362/427
2015/0131276 A1 * 5/2015 Thompson ..... F21V 21/0965 362/371
2018/0041053 A1 * 2/2018 Capizzo ..... A63H 30/04
2019/0039825 A1 * 2/2019 Leonard ..... F16M 11/26
2020/0046145 A1 * 2/2020 Kemery ..... F16M 11/10
2021/0114175 A1 * 4/2021 Prinzivalli ..... F16B 1/00

OTHER PUBLICATIONS

"Tibres—Sliding Barn Door Latch Lock for Locking Barns", https://www.amazon.com/Tibres-Sliding-Locking-Wrought-Element/dp/B01MTUG6A7.
"Charger Stand by RLPowerV1", https://www.rlpower.net/products/charger-stand.
"Andoer Universal RC Transmitter Pallet Tray Holder Bracket Stand with Neck Strap for Futaba JR Spektrum DJI Walkera Esky Transmitter Model", https://www.amazon.com/Universal-Transmitter-Bracket-Spektrum-Walkera/dp/B013P158TS.
"Duratrax PitTech Deluxe RC Car and Truck Work Stand, Blue", https://www.amazon.com/Duratrax-Tech-Deluxe-Truck-Stand/dp/B0014T74MS.

* cited by examiner

CONSOLIDATED PIT STAND AND CADDY FOR REMOTE-CONTROLLED HOBBY VEHICLES

The current application claims a priority to the U.S. Provisional Patent application Ser. No. 62/830,009 filed on Apr. 5, 2019.

FIELD OF THE INVENTION

The present invention relates generally to apparatuses for storing and transporting remote-controlled hobby vehicles and such. More specifically, the present invention is a consolidated pit stand and caddy for storing and transporting remote-controlled hobby vehicles.

BACKGROUND OF THE INVENTION

In present society, there has been a growing interest in remote-controlled (RC) vehicles as a hobbyist activity. In cases, such an interest can lead to professional racing and such involving remote controlled vehicles. Although the activity itself can be immensely entertaining and pleasurable, the preparation prior to the start of using a RC vehicle and the stowing away of said RC vehicle after use can be cumbersome and a nuisance for some users. For instance, it can be troublesome and time-consuming for a user to transport their RC vehicle and the tools necessary to the RC vehicle without there being an all-inclusive, consolidated device to store and transport the RC vehicle with the tools. Additionally, it can often be a chore for users to unload and organize their tools needed for the RC vehicle while having a sufficient floor space to perform checks and maintenance on the RC vehicle. Also, there are no efficient apparatus that combines a pit stand for RC vehicles with a caddy that can contain the pit stand with the RC vehicle and the tools needed for the RC vehicle without risking damages to the RC vehicle. Finally, there are no efficient pit stands containing the necessary features relevant to servicing a RC vehicle, such as power supply space, sufficient and modular lighting, a container for chargers, and other relevant needs related to RC vehicles.

An objective of the present invention is to provide users with a device that can be an all-inclusive, consolidated pit stand and caddy. The present invention intends to provide users with a device that can contain a storage bag containing a dedicated pit area and dedicated space for storing tools. An objective of this storage bag can be to provide users with a means of easily unloading the apparatus as efficiently as possible, while making the stowing away of RC vehicles and such just as efficient. The present invention intends to provide users with a device that can contain a pit stand capable of holding a RC vehicle while containing necessary features needed for servicing a RC vehicle.

SUMMARY OF THE INVENTION

The present invention is a consolidated pit stand and caddy. The present invention primarily contains a caddy and a pit stand. The caddy can be a storage bag that can be fully opened or closed. The caddy can primarily contain a pit area and a tool area. The pit stand is primarily located on the pit area of the caddy. The pit stand primarily contains a base, a plurality of shelfs, a charger-stand, and a power supply tray. The plurality of shelfs provide a platform to hold the RC vehicle and may contain an integrated lighting sources.

DETAIL DESCRIPTIONS OF THE INVENTION

Figure 1:
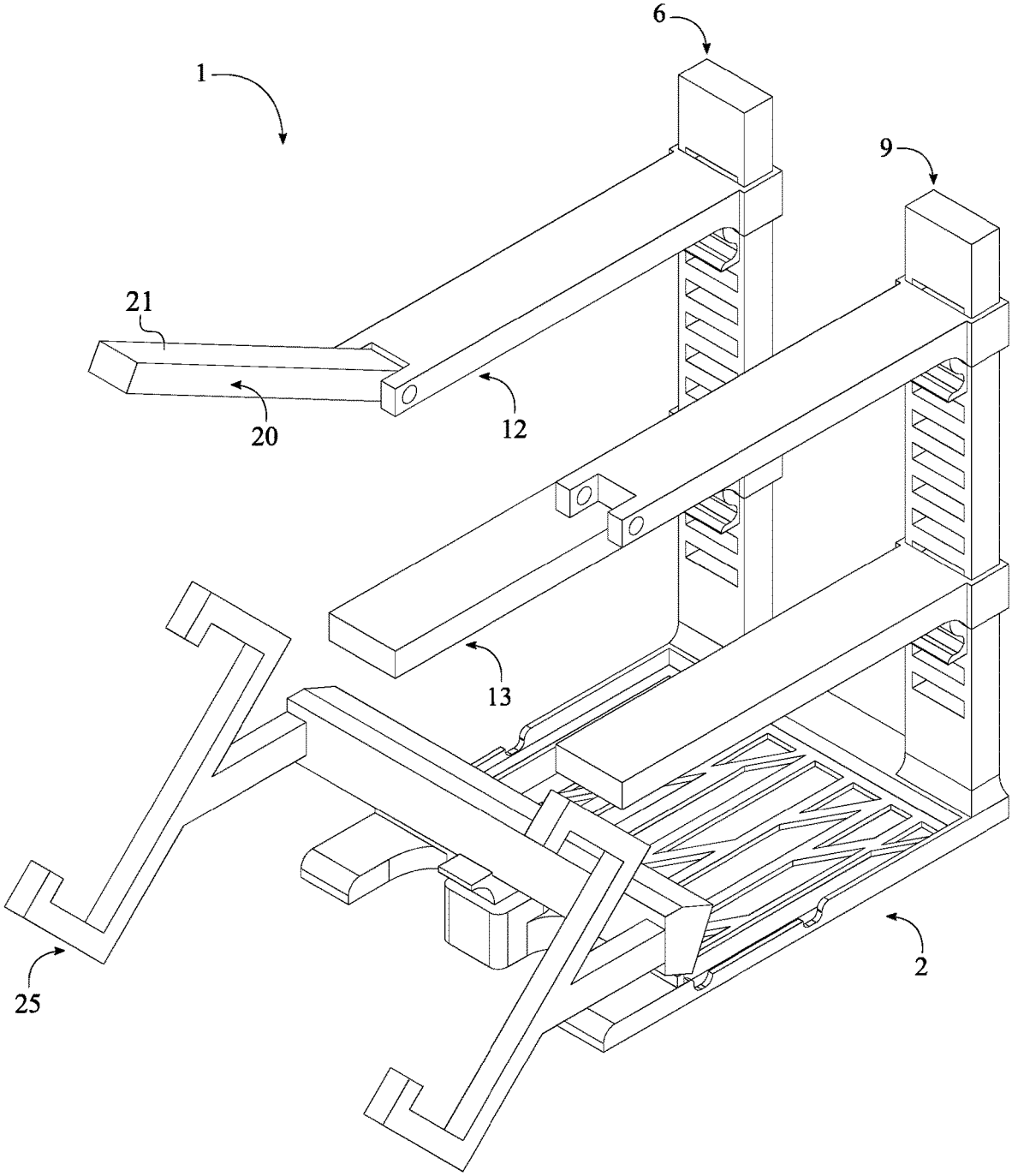
FIG. 1 is a perspective view of the pit stand of the present invention.

All illustrations of the drawings are for the purpose of describing selected versions of the present invention and are not intended to limit the scope of the present invention.

The present invention is a consolidated pit stand 1 and caddy 29 for remote-controlled hobby vehicles. More specifically, the present invention comprises a pit stand 1 to secure a remote-controlled hobby vehicle so that an individual can store, prepare, and service the remote-controlled hobby vehicle. Furthermore, the present invention comprises a caddy 29 that functions as a storage bag, a pit area, and a tool storage area for the remote-controlled hobby vehicle.

In reference to the general configuration of the present invention, the pit stand 1 comprises a base 2, a first pillar 6, a second pillar 9, an upper adjustable shelf 12, at least one lower adjustable shelf 13, an illuminating arm assembly 20, and a storage section 25. The first pillar 6 and the second pillar 9 are oppositely positioned of each other about the base 2 thus delineating the height of the pit stand 1. The first pillar 6 and the second pillar 9 are terminally connected onto the base 2 so that the first pillar 6 and the second pillar 9 can be vertically supported by the base 2. The upper adjustable shelf 12 is removably mounted to the first pillar 6 and the second pillar 9, wherein the upper adjustable shelf 12 provide storage area for the remote-controlled hobby vehicle to be stored. The at least one lower adjustable shelf 13 is removably mounted to the first pillar 6 and the second pillar 9 as the lower adjustable shelf 13 provides another storage area for the remote-controlled hobby vehicle to be stored. The illuminating arm assembly 20 is foldably connected to the upper adjustable shelf 12 so that the pit area of the caddy 29, vehicle servicing area, can be illuminated. The storage section 25 is oppositely positioned of the first pillar 6 and the second pillar 9 and removably mounted to the base 2. The storage section 25 provides sufficient storage area for related parts of the remote-controlled hobby vehicle during the transportation of the present invention. The caddy 29 can be configured between an opened configuration and a closed configuration. The opened configuration grants access to the pit area and the tool storage area so the user can service or prepare the remote-controlled hobby vehicle. The closed configuration converts the caddy 29 into a storage bag and enables the user to easily and securely transport the present invention as the remote-controlled hobby vehicle is strapped onto the pit stand 1.

The base 2 functions as the primary structural body of the present invention as the rest of the components of the present invention are configured upon the base 2. In reference to FIG. 1, the base 2 comprises a rear platform 3, a storage rack 4, and a front bracket receiver 5. The rear platform 3 is a flat surface area and enables the first pillar 6 and the second pillar 9 to be connected. The rear platform 3 is terminally connected to the storage rack 4 to hold a power supply that functions as a rectifier. More specifically, the power supply changes alternating current to direct current so that a battery 23 of the remote-controlled hobby vehicle can be charged. Preferably, the storage rack 4 is formed into a quadrilateral-like shaped figure and comprises a plurality of cut-outs. The plurality of cut-outs can be of any shape, size, orientation, and arrangements of components that would allow the storage rack 4 to improve the air circulation so that any heat energy generated by the power supply can be easily dissipated into the surrounding air. The front bracket receiver 5 is terminally connected to the storage rack 4 as the rear platform 3 and the front bracket are oppositely positioned of each other about the storage rack 4. The front bracket functions as a female adapter to receive the storage section 25 so that the storage section 25 can be removably mounted to the base 2.

Figure 2:
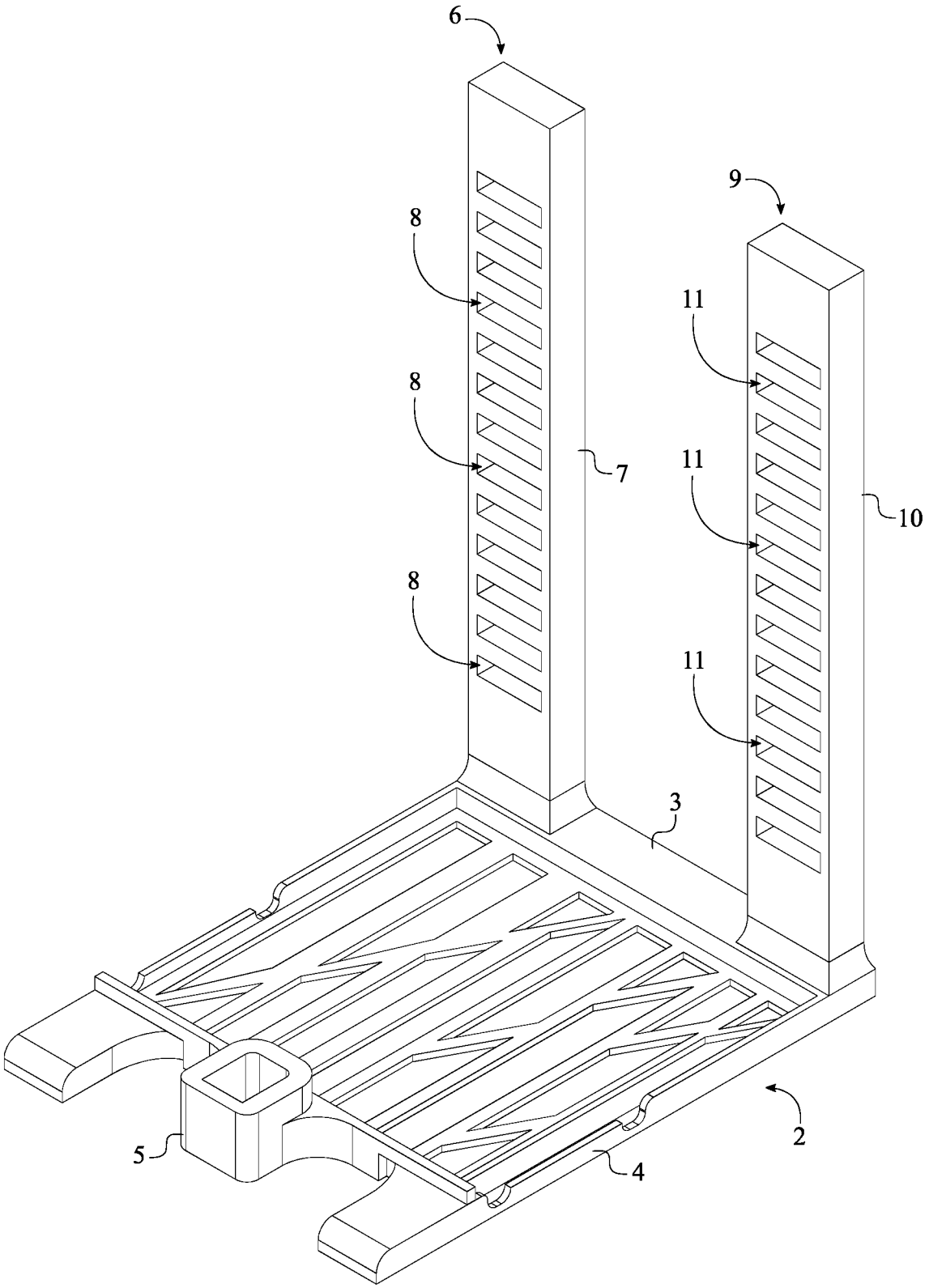
FIG. 2 is a perspective view of the base, the first pillar, and the second pillar of the pit stand of the present invention.

The first pillar 6 is generally a rectangular body that defines the overall height of the pit stand 1. In reference to FIG. 2, the first pillar 6 comprises a first elongated body 7 and a plurality of first openings 8. The plurality of first openings 8 is equally distributed along the first elongated body 7 and traverses into the first elongated body 7. The plurality of first openings 8 is oriented towards the front bracket so that the upper adjustable shelf 12 and the lower adjustable shelf 13 can also be oriented towards the front bracket. More specifically, the plurality of first openings 8 allows the upper adjustable shelf 12 and the lower adjustable shelf 13 to be engaged with the first pillar 6 from an end of the corresponding shelf. The first elongated body 7 is terminally connected onto the rear platform 3, wherein a free end of the first pillar 6 is positioned offset from the rear platform 3 thus defining the highest point of the first pillar 6.

Figure 3:
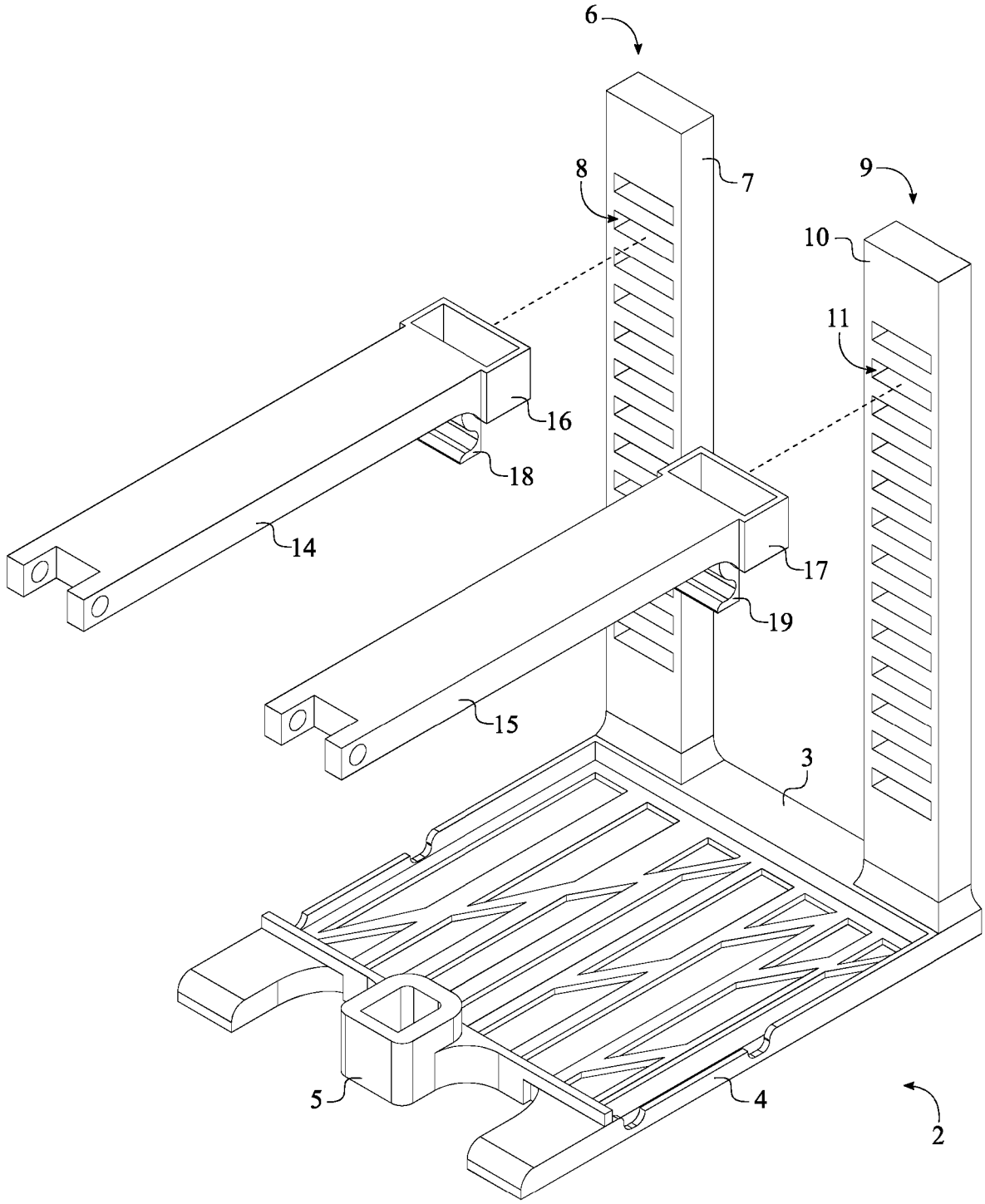
FIG. 3 is an exploded view between the upper adjustable shelf, the first pillar, and the second pillar of the present invention.
Figure 4:
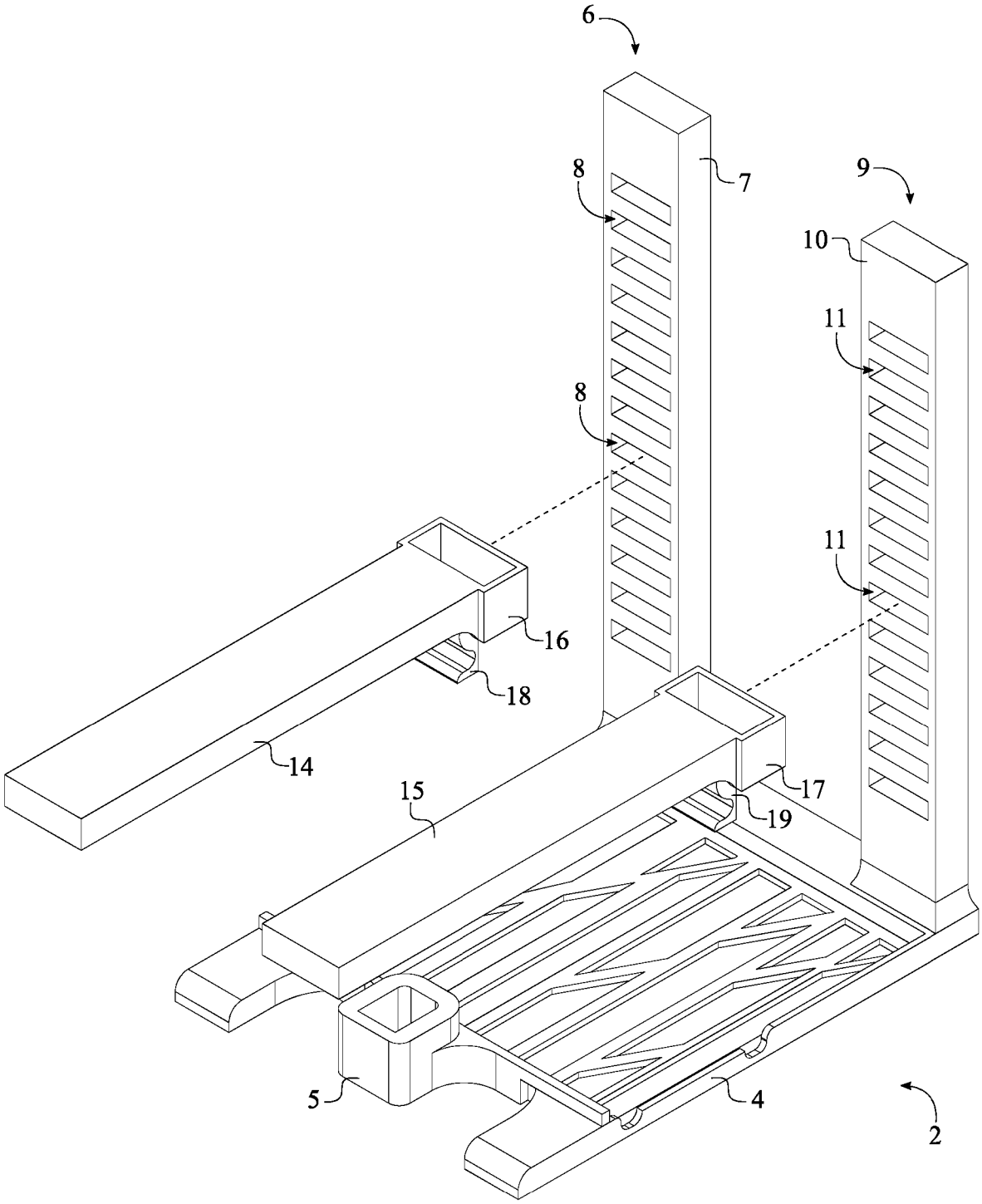
FIG. 4 is an exploded view between the lower adjustable shelf, the first pillar, and the second pillar of the present invention.

The second pillar 9 is generally a rectangular body that defines the overall height of the pit stand 1. In reference to FIG. 2, the second pillar 9 comprises a second elongated body 10 and a plurality of second openings 11. The plurality of second openings 11 is equally distributed along the second elongated body 10 and traverses into the second elongated body 10. The plurality of second openings 11 is oriented towards the front bracket so that the upper adjustable shelf 12 and the lower adjustable shelf 13 can also be oriented towards the front bracket. More specifically, the plurality of second openings 11 allows the upper adjustable shelf 12 and the lower adjustable shelf 13 to be engaged with the second pillar 9 from an opposite end of the corresponding shelf. The second elongated body 10 is terminally connected onto the rear platform 3, wherein a free end of the second pillar 9 is positioned offset from the rear platform 3 thus defining the highest point of the second pillar 9.

the upper adjustable shelf 12 and the lower adjustable shelf 13 each comprising a first support 14, a second support 15, a first bracket 16, a second bracket 17, a first tension lock 18, and a second tension lock 19. In reference to FIG. 3-4, the first support 14 is terminally connected to the first bracket 16, wherein the first support 14 and the first bracket 16 collectively delineate one of the supporting arm of the upper adjustable shelf 12 or the lower adjustable shelf 13. The first tension lock 18 is adjacently connected to the first bracket 16 so that the first tension lock 18 can easily and tensionably engage within one of the plurality of first opening 8. Furthermore, the first tension lock 18 can be disengaged from the corresponding opening of the plurality of first opening 8 so that the height of the upper adjustable shelf 12 or the lower adjustable shelf 13 can be adjusted. In reference to FIG. 3-4, the second support 15 is terminally connected to the second bracket 17, wherein the second support 15 and the second bracket 17 collectively delineate another supporting arm of the upper adjustable shelf 12 or the lower adjustable shelf 13. The second tension lock 19 is adjacently connected to the second bracket 17 so that the second tension lock 19 can easily and tensionably engage within one of the plurality of second opening 11. Furthermore, the second tension lock 19 can be disengaged from the corresponding opening of the plurality of second opening 11 so that the height of the upper adjustable shelf 12 or the lower adjustable shelf 13 can be adjusted. Moreover, the first bracket 16 and the second bracket 17 are positioned parallel to the rear platform 3 so that the upper adjustable shelf 12 and the lower adjustable shelf 13 can be parallelly engaged with the first pillar 6 and the second pillar 9.

Figure 5:
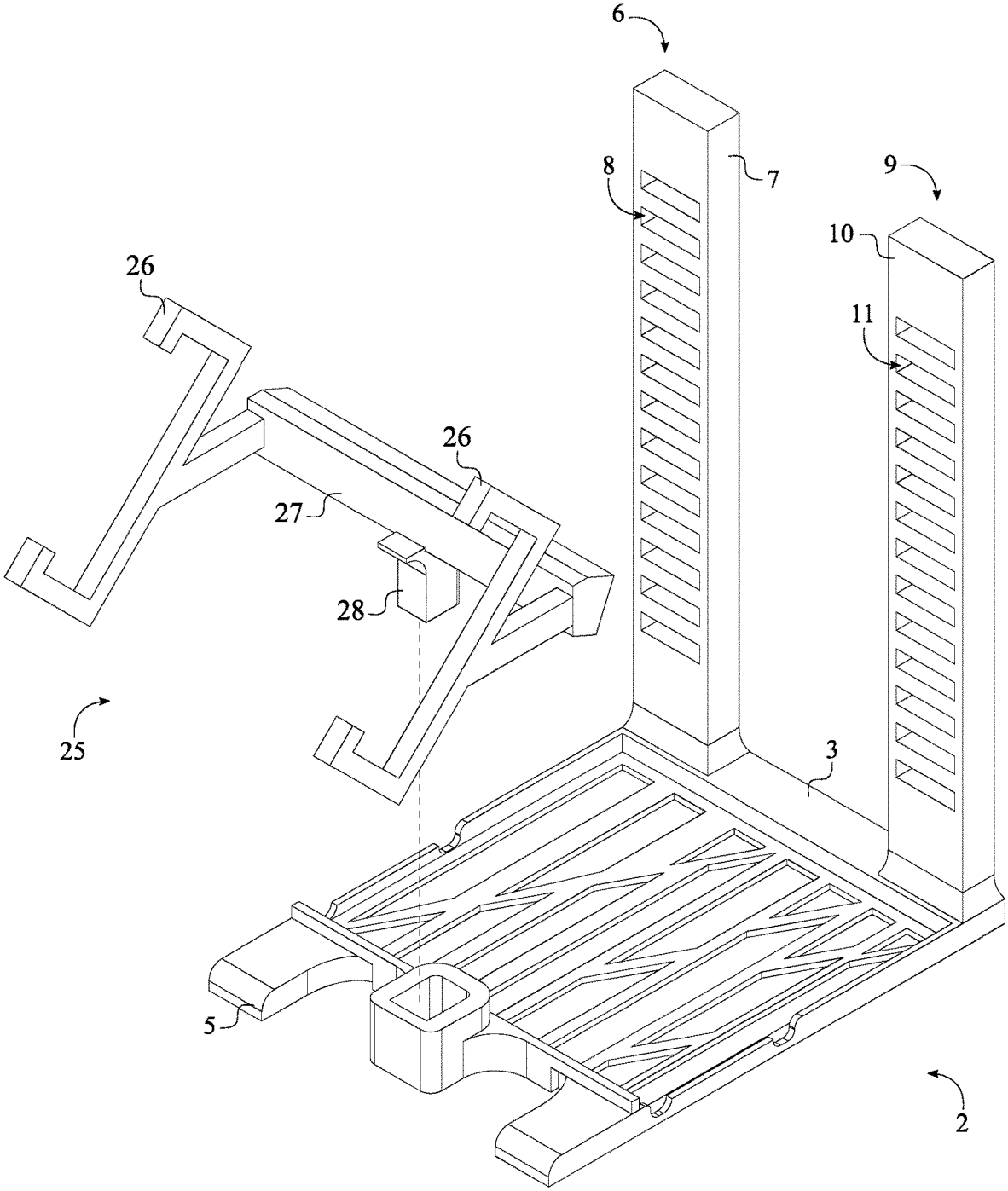
FIG. 5 is an exploded view between the base and the storage section of the present invention.

The storage section 25 is configured to receive a charger unit that charges the battery 23 of the remote-controlled hobby vehicle. In reference to FIG. 5, the storage section 25 comprises a pair of brackets 26, a cross plate 27, and a male support 28. The pair of brackets 26 are terminally connected to the cross plate 27 and delineates U-shaped structural body so that the charger unit can be pressed into the pair of brackets 26. The cross plate 27 function as the intermediate body between the pair of brackets 26 and the male support 28. The male support 28 is centrally connected to the cross plate 27 and positioned in between the pair of brackets 26. The male support 28 removably engages within the front bracket receiver 5. As a result, the user can either remove the storage section 25 from the base 2 or secure the storage section 25 to the base 2 depending upon user's preference. Furthermore, the male support 28 is preferably formed as the general shape and size similar to the front bracket receiver 5 in order to simplify the engagement between the corresponding components.

Figure 6:
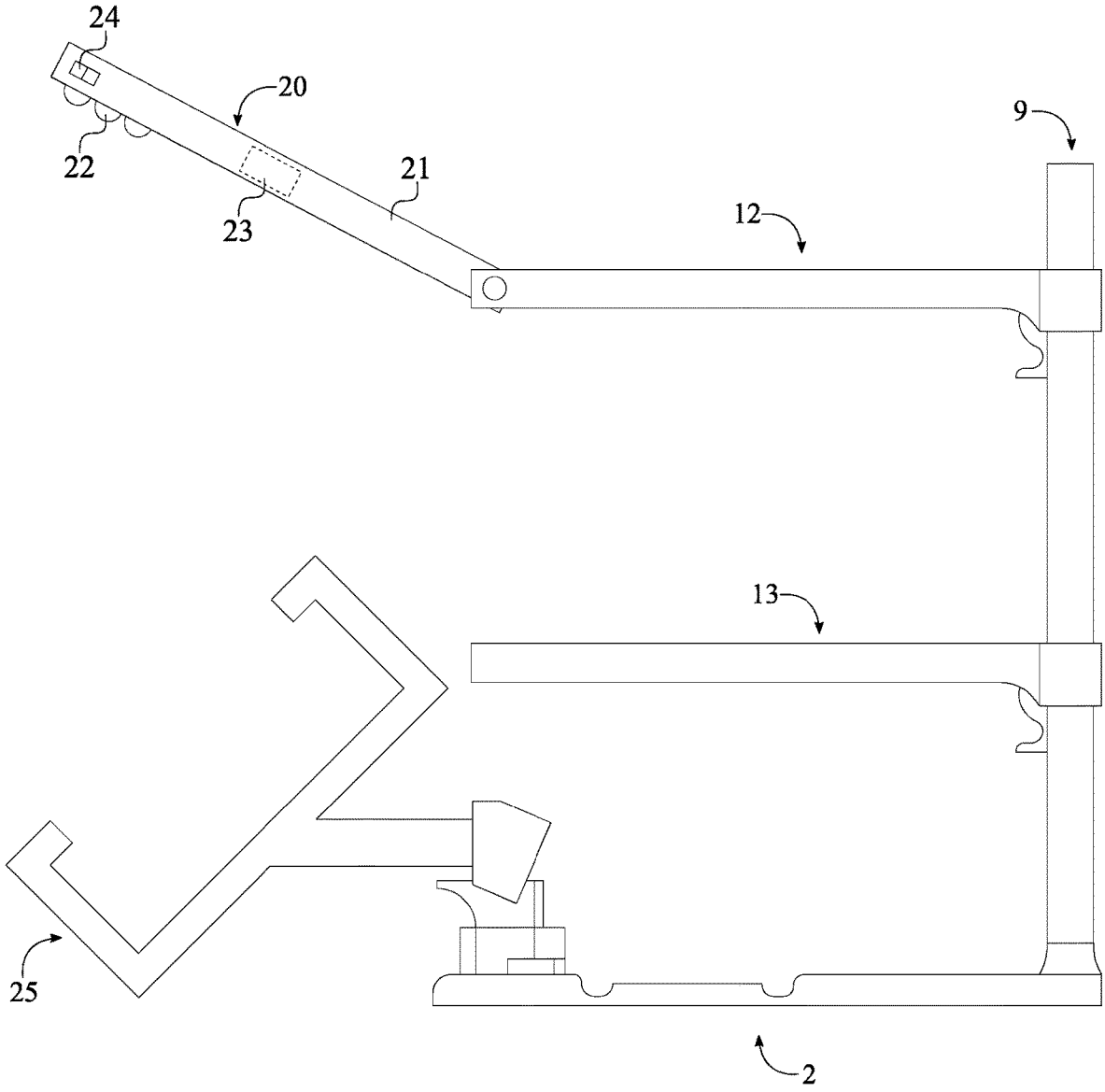
FIG. 6 is a side view of the pit stand of the present invention, showing the components of the illuminating arm assembly.
Figure 7:
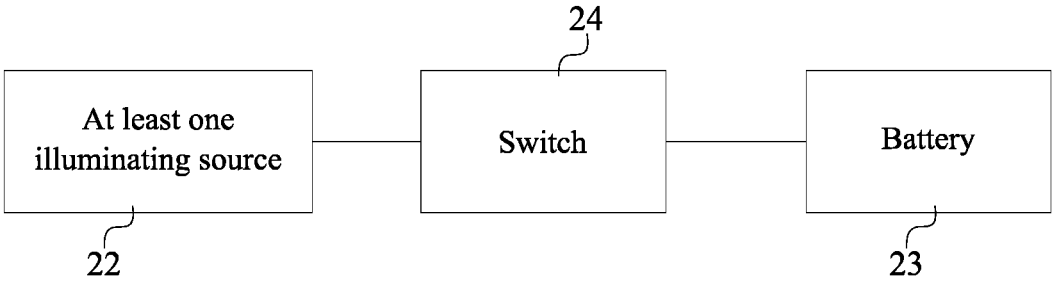
FIG. 7 is a schematic view of electrical connections of the illuminating arm assembly.

The illuminating arm functions as a lighting source for the pit area of the caddy 29 so that the user can comfortably work on their remote-controlled hobby vehicles under low light conditions. In reference to FIG. 6-7, the illuminating arm assembly 20 comprises an arm body 21, at least one illuminating source 22, a battery 23, and a switch 24. It is preferred that the illuminating source 22 is located on the exterior surfaces of the arm body 21 as the illuminating source 22 and the switch 24 are integrated into the arm body 21. Preferably, the lighting source is a light emitting diode type, although other types and kinds of lighting emitting sources could be utilized as well. The battery 23 is removably mounted within the arm body 21, wherein the illuminating source 22 is electrically connected with the battery 23 through the switch 24. As a result, the user can turn-on or turn-off the illuminating source 22 through the switch 24. The arm body 21 is foldably connected to the upper adjustable shelf 12 so that the illuminating arm can be stored away when it is not utilized by the user. Preferably, the hinge is located on the side face of the arm body 21 and near to the rear end of the arm body 21. the hinge is preferably connected with a pair of holes of the first support 14 or the second support 15 of the upper adjustable shelf 12 while allowing the arm body 21 to be pivoted about at this interaction between the hinge and the pair of holes The caddy 29 that functions as a storage bag, a pit area, and a tool storage area for the remote-controlled hobby vehicle comprises a base panel 30, a front panel 31, a rear panel 32, a right panel 33, a left panel 34, and a tool pouch 35. In reference to FIG. 8-9, the front panel 31 is terminally connected to the base panel 30. The rear panel 32 is terminally connected to the base panel 30 and positioned opposite of the front panel 31. The right panel 33 is terminally connected to the base panel 30, and the left panel 34 is terminally connected to the base panel 30. The right panel 33 and the left panel 34 are positioned in between the front panel 31 and the rear panel 32. In other words, the front panel 31, the left panel 34, the rear panel 32, and the right panel 33 are perimetrically connected around the base panel 30 thus forming the general configuration of the caddy 29. The tool pouch 35 is connected onto the front panel 31 so that the user can organize and store tools that are related to the remote-controlled hobby vehicle. Furthermore, the caddy 29 can interchange between an opened configuration and a closed configuration in order to provide multiple functionality for the remote-controlled hobby vehicle.

Figure 8:
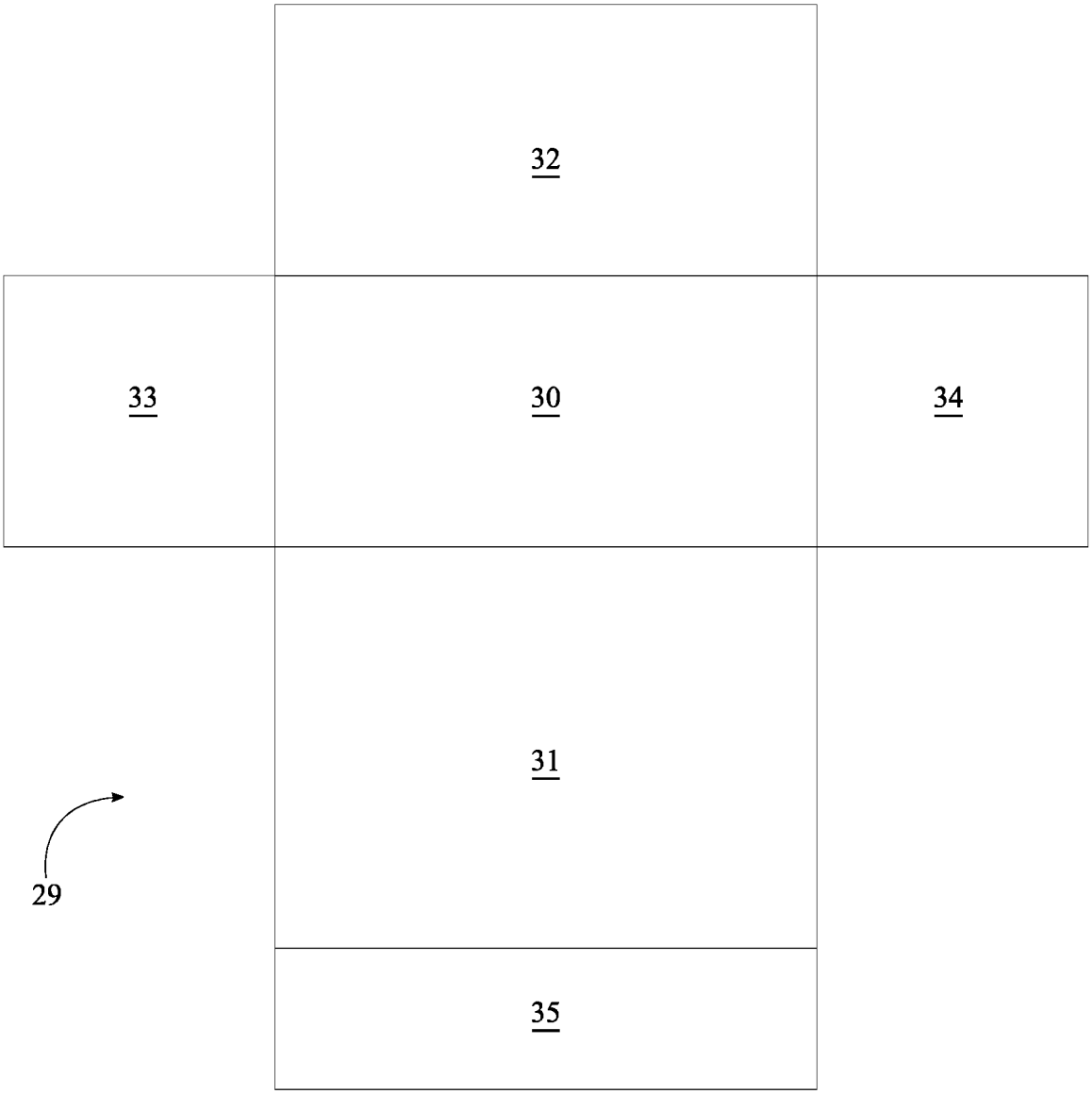
FIG. 8 is an opened configuration of the caddy of the present invention.

In reference to FIG. 8, when the caddy 29 is configured to the opened configuration, the caddy 29 is able to function as the pit area and open up the tool pouch 35 to the user. More specifically, the right panel 33 and the left panel 34 are positioned parallel and complainer to the base panel 30. The rear panel 32 and the front panel 31 are positioned parallel and complainer to the base panel 30. Resultantly, the tool pouch 35 is oriented outward from the front panel 31 and towards the user, wherein the stored tools of the tool pouch 35 is accessible for usage.

Figure 9:
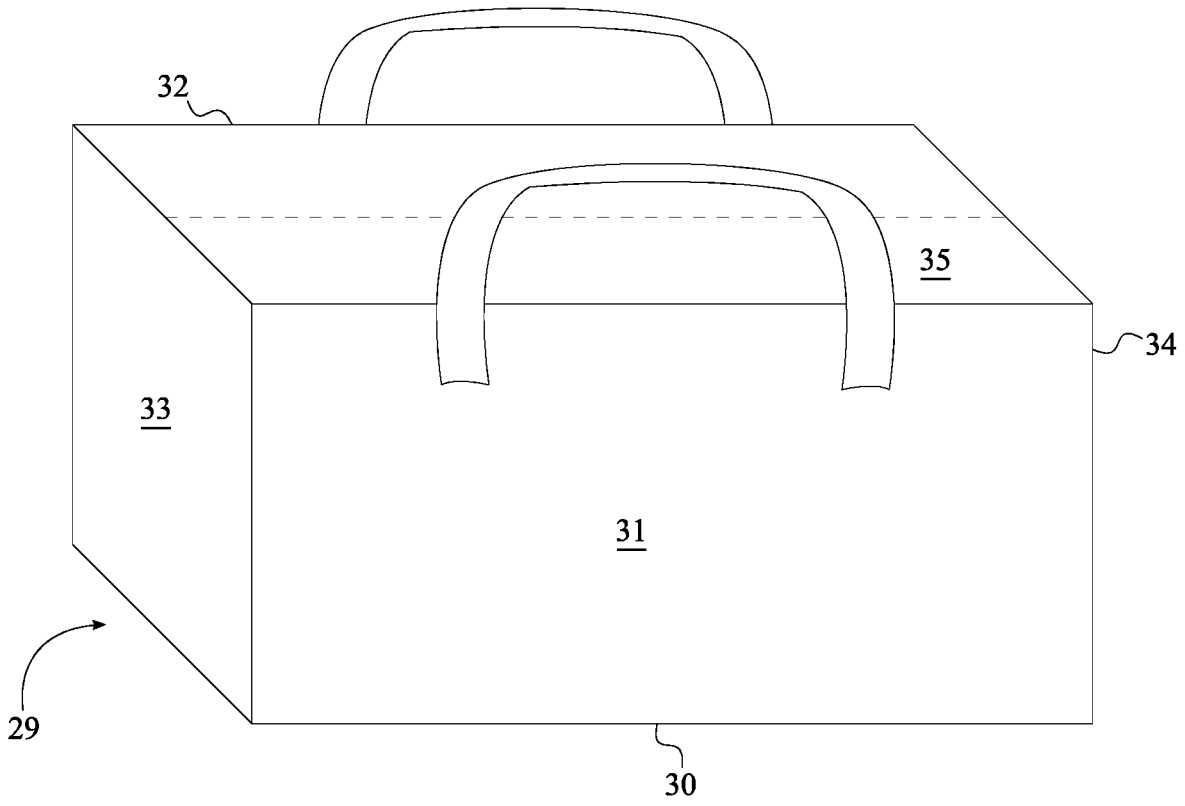
FIG. 9 is a closed configuration of the caddy of the present invention.

In reference to FIG. 9, when the caddy 29 is configured to the closed configuration, the caddy 29 is able to function as the storage bag to the user. More specifically, the rear panel 32 is perimetrically mounted to the left panel 34 and the right panel 33. The front panel 31 is perimetrically mounted to the left panel 34 and the right panel 33. As a result, the base panel 30, the front panel 31, the rear panel 32, the right panel 33, and the left panel 34 are able to delineate a storage compartment for the remote-controlled hobby vehicle. The rear panel 32 and the front panel 31 are mounted to each other, opposite of the base panel 30, so that the storage compartment can be closed. The tool pouch 35 is oriented inward toward the base panel 30, wherein the stored tool of the tool pouch 35 is not accessible for usage. Furthermore, the mounting feature of the closed configuration is completed through an easily detachable mounting apparatus such as zippers, male and female fasteners, magnetic fasteners, or any other types of similar fasteners.

Although the invention has been explained in relation to its preferred embodiment, it is to be understood that many other possible modifications and variations can be made without departing from the spirit and scope of the invention as hereinafter claimed.

What is claimed is:

1. A consolidated pit stand and the caddy for remote-controlled hobby vehicles comprising:

a pit stand;

the pit stand comprising a base, a first pillar, a second pillar, an upper adjustable shelf, at least one lower adjustable shelf, an illuminating arm assembly, and a storage section;

the first pillar and the second pillar being oppositely positioned of each other about the base;

the first pillar and the second pillar being terminally connected onto the base;

the upper adjustable shelf being removably mounted to the first pillar and the second pillar;

the at least one lower adjustable shelf being removably mounted to the first pillar and the second pillar;

the illuminating arm assembly being foldably connected to the upper adjustable shelf;

the storage section being oppositely positioned of the first pillar and the second pillar;

the storage section being removably mounted to the base;

the base comprising a rear platform, a storage rack, and a front bracket receiver;

the rear platform being terminally connected to the storage rack;

the front bracket receiver being terminally connected to the storage rack;

the rear platform and the front bracket being oppositely positioned of each other about the storage rack;

the first pillar comprising a first elongated body and a plurality of first openings;

the plurality of first openings being equally distributed along the first elongated body;

the plurality of first openings traversing into the first elongated body;

the first elongated body being terminally connected onto a rear platform of the base;

the second pillar comprising a second elongated body and a plurality of second openings;

the plurality of second openings being equally distributed along the second elongated body;

the plurality of second openings traversing into the second elongated body;

the second elongated body being terminally connected onto a rear platform of the base;

the upper adjustable shelf and the lower adjustable shelf each comprising a first support, a second support, a first bracket, a second bracket, a first tension lock, and a second tension lock;

the first pillar comprising a plurality of first openings;

the second pillar comprising a plurality of second openings;

the first support being terminally connected to the first bracket;

the first tension lock being adjacently connected to the first bracket;

the second support being terminally connected to the second bracket;

the second tension lock being adjacently connected to the second bracket;

the first support and the second support being oriented complainer to each other;

the first tension lock being tensionably engaged within one of the plurality of first openings of the first pillar;

the second tension lock being tensionably engaged within one of the plurality of second openings of the first pillar;

the storage section comprising a pair of brackets, a cross plate, and a male support;

the pair of brackets being terminally connected to the cross plate;

the male support being centrally connected to the cross plate;

the male support being positioned in between the pair of brackets; and the male support being removably engaged within a front bracket receiver of the base.

2. The consolidated pit stand and the caddy for remote-controlled hobby vehicles as claimed in claim 1 comprising:

the illuminating arm assembly comprising an arm body, at least one illuminating source, a battery, and a switch;

the illuminating source and the switch being integrated into the arm body;

the battery being removably mounted within the arm body;

the illuminating source being electrically connected with the battery through the switch; and the arm body being foldably connected to the upper adjustable shelf.

3. The consolidated pit stand and the caddy for remote-controlled hobby vehicles as claimed in claim 1 comprising:

a caddy;

the caddy comprising a base panel, a front panel, a rear panel, a right panel, a left panel, and a tool pouch;

the front panel being terminally connected to the base panel;

the rear panel being terminally connected to the base panel, opposite of the front panel;

the right panel being terminally connected to the base panel;

the left panel being terminally connected to the base panel;

the right panel and the left panel being positioned in between the front panel and the rear panel; and the tool pouch being connected onto the front panel.

4. The consolidated pit stand and the caddy for remote-controlled hobby vehicles as claimed in claim 3 comprising:

an opened configuration;

the right panel and the left panel being positioned parallel to the base panel;

the rear panel and the front panel being positioned parallel to the base panel; and the tool pouch being oriented outward from the front panel, wherein the stored tools of the tool pouch is accessible for usage.

5. The consolidated pit stand and the caddy for remote-controlled hobby vehicles as claimed in claim 3 comprising:

a closed configuration;

the rear panel being perimetrically mounted to the left panel and the right panel;

the front panel being perimetrically mounted to the left panel and the right panel;

the rear panel and the front panel being mounted to each other, opposite of the base panel; and the tool pouch being oriented inward toward the base panel, wherein the stored tool of the tool pouch is not accessible for usage.

* * * * *